United States Patent [19]

Cassier

[11] 4,040,183

[45] Aug. 9, 1977

[54] COIN ROLL OPENER

[76] Inventor: Robert X. Cassier, 115 Mount Auburn St., Cambridge, Mass. 02138

[21] Appl. No.: 771,952

[22] Filed: Feb. 25, 1977

Related U.S. Application Data

[63] Continuation-in-part of Ser. No. 660,727, March 17, 1976, abandoned.

[51] Int. Cl.[2] ..... B26B 27/00

[52] U.S. Cl. ..... 30/296 R

[58] Field of Search ..... 30/296 R, 290, 273

[56] References Cited

U.S. PATENT DOCUMENTS

| | | | |
|---|---|---|---|
| 581,720 | 5/1897 | Hathaway | 30/296 R |
| 1,473,383 | 11/1923 | Riker | 30/296 R |
| 1,620,572 | 3/1927 | Rosenblum | 30/296 R |
| 1,886,021 | 11/1932 | Huff | 30/296 R |
| 2,576,492 | 11/1951 | Vogel | 30/296 R |

*Primary Examiner*—James L. Jones, Jr.
*Assistant Examiner*—J. T. Zatarga
*Attorney, Agent, or Firm*—Morse, Altman, Oates & Bello

[57] ABSTRACT

A device for opening a package of coins contained within a cylindrical wrapper includes a base having a gripping stratum affixed to a bottom face thereof. A thin rectangular body with an upturned flange at one side thereof is attached to an upper face of the base. The body and flange have a substantially L-shaped profile in right cross section, the flange being parallel to a longitudinal axis of the body. As a package of coins is rolled along the longitudinal axis of the body, the upturned edge engages and severs the wrapper. The gripping stratum prevents movement of the device as the package is rolled along the flange.

10 Claims, 4 Drawing Figures

COIN ROLL OPENER

CROSS-REFERENCE TO RELATED APPLICATION

This application is a continuation-in-part of my application Ser. No. 660,727, filed on Mar. 17, 1976 for a Coin Roll Opener, now abandoned.

BACKGROUND AND SUMMARY OF THE INVENTION

The present invention relates to devices for opening packages and, more particularly, is directed towards devices for opening rolls of coins.

It is an opject of the present invention to provide a coin roll opener for efficiently and quickly severing a coin wrapper to permit removal of the coins.

The invention is characterized by a body in the form of a thin rectangular sheet of metal having one of its longitudinal edges turned upwardly at a ninety degree bend to form a dulled blade which is parallel to a longitudinal axis of the sheet. The height of the blade is sufficiently high to sever only the wrapper containing a roll of coins. The sheet is mounted on an upper face of a substantially rectangular base with the dulled blade extending upwardly. A gripping stratum is attached to an opposite face of the base. As a package of coins is rolled along the longitudinal axis of the body, the dulled blade engages and severs the wrapper. The gripping stratum prevents movement of the base as the package of coins is rolled along the blade.

Other objects of the present invention will in part be obvious and will in part appear hereinafter.

The invention accordingly comprises the apparatuses and systems, together with their parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
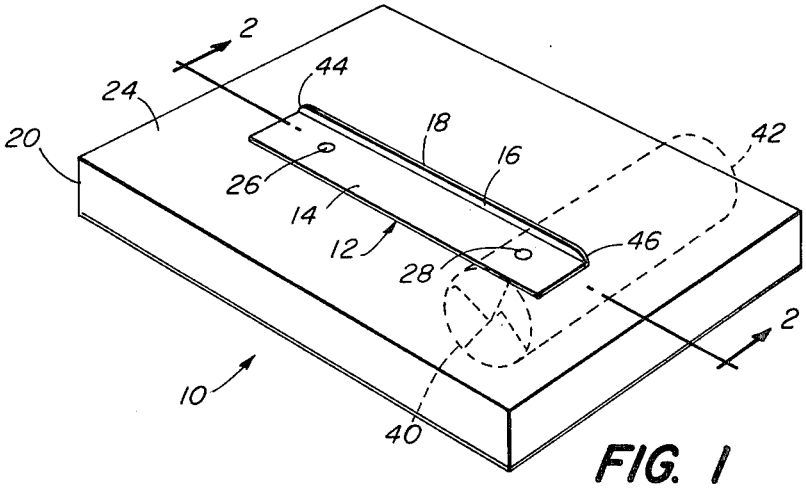
FIG. 1 is a perspective view of a roll coin opener embodying the present invention.

Referring now to the drawings, particularly FIG. 1, there is shown a coin roll opener 10 embodying the present invention. Coin roll opener 10 comprises a substantially rectangular body 12 which is fabricated from a thin sheet of metal such as steel, preferably a high carbon steel. The thickness of body 12 is in the range of 0.006 inch to 0.010 inch and preferably 0.008 inch. The length of body 12 is at least as long as the circumference of a roll of coins and the width of body 12 is approximately 0.75 inch. In the illustrated embodiment, the length of body 12 is approximately 3.75 inches. One of the long sides of body 12 is bent upwardly at ninety degrees to form a substantially L-shaped structure constituted by a wide base 14 and a narrow flange 16. The inside height of flange 16 from the upper face of base 14 is in the range of 1/32 of an inch to 3.32 of an inch and preferably 1/16 of an inch. The upper or working edge 18 of flange 16 is dulled to prevent marring of the coins.

Body 12 is attached to a platform 20 by means of a suitable adhesive 22. Base 14 is superposed on platform 20 in parallel relationship with an upper face 24 thereof. Flange 16 is disposed along the center line of platform 20 in perpendicular relationship to face 24. Base 14 is formed with a pair of through holes 26, 28 into which adhesive 22 flows for improved bonding of body 12 and platform 20. In the illustrated embodiment, platform 12 has a substantially rectangular profile, approximately five inches long, four inches wide and three-eighths inch thick. Platform 20 is composed of a natural or synthetic material such as wood, plywood, pressed wood, a plastic such as an acrylic or a polyamide resin.

Figure 4:
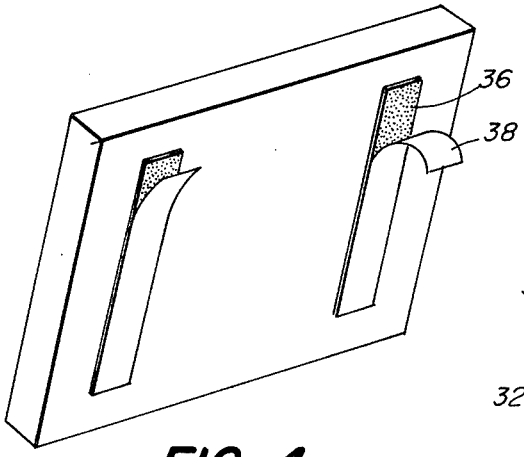
FIG. 4 is a bottom view of an alternate embodiment of the base of FIG. 3 having pressure sensitive adhesive strips applied thereto.
Figure 3:
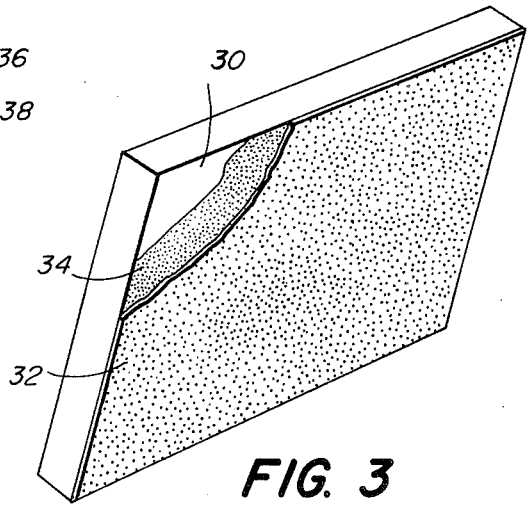
FIG. 3 is a bottom view of the base of the roll coin opener showing the gripping surface.

As best shown in FIG. 3, a lower face 30 of platfrom 20 is provided with a gripping surface 32 or stratum having an abrasive surface. In the illustrated embodiment, gripping stratum 32 is a sheet of cloth having fine crystals of aluminum oxide embedded in a matrix of iron oxide, such as 120 mesh emery cloth. In an alternative embodiment, gripping stratum 32 is sandpaper. Emery cloth 32, which has a profile that corresponds to platform 20, is attached to lower face 30 by means of a suitable adhesive 34. In an alternate embodiment shown in FIG. 4, the gripping surface is provided by a pair of pressure sensitive adhesive strips 36 having removable release strata 38 attached thereto.

Figure 2:
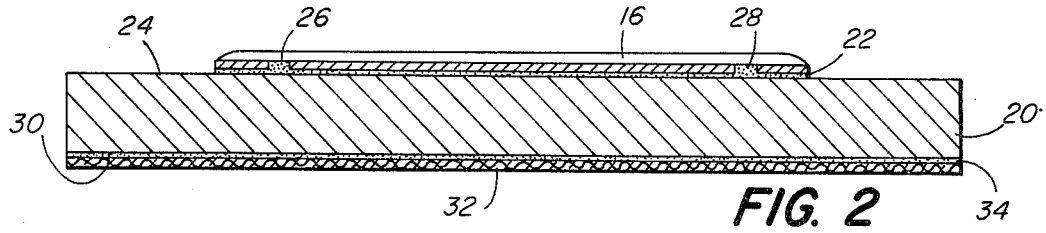
FIG. 2 is a sectional view taken along the lines 2—2 of FIG. 1.

In operation, platform 20 is placed on a cash register or other flat surface. A package or roll 40 of coins in a cylindrical paper wrapper 42 is placed on platform 20 with the longitudinal axis of the coin roll being perpendicular to the longitudinal axis of flange 16. As best shown in FIG. 2, ends 44 and 46 of flange 16 are tapered to facilitate opening of the coin roll. The package of coins is rolled onto flange 16 and tapered end 46 engages wrapper 42 intermediate its ends. As coin package 40 is moved along flange 16 by pressing downwardly and forwardly with the palm of the hand, dulled edge 18 severs wrapper 42 between two adjacent coins in the package. Flange 16 is sufficiently high to sever only wrapper 42 and is sufficiently thin and dulled so that it passes between adjacent coins in the roll. That is, the dulled and thin edge of flange 16 is such that coin roll 40 rides thereon until the flange slips between two adjacent coins and penetrates through wrapper 42. As flange 16 is rolled forward, it severs wrapper 42. If flange 16 were not thin, it would not pass between adjacent coins. If flange 16 were not dulled, an exposed cutting edge would be a hazard to personnel and would mar the coins. Coin roll 40 is rolled along flange 16 until the entire periphery of the roll has been severed. The length of flange 16 is sufficently long to permit at least one complete rotation of coin roll 40. That is, the length of flange 16 is at least equal to the circumference of any coin roll that is to be opened. Gripping surface 32 prevents movement of platform 20 as coin roll 40 is opened.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A device for opening a plurality of coins packaged in a paper wrapper defining a roll, said device comprising:

a. a thin body having a pair of relatively long parallel sides and a pair of relatively short parallel sides, a margin of one of said long sides bent upwardly to form a substantially L-shaped structure constituting a wide base and a narrow flange having a dulled edge, a longitudinal axis of said flange being disposed in parallel relationship to a longitudinal axis of said base, the width of said base is larger than the height of said flange, the length of said flange is at least as long as the circumference of the roll of coins, the height of said flange being sufficiently high to allow said flange to cut only through the paper wrapper when the roll of coins is rolled on said flange in a direction that is along the longitudinal axis of said flange;

b. a platform, said body mounted on an upper face of said platform; and c. gripping means on a lower face of said platform for preventing movement of said platform when the roll of coins is rolled along said flange.

2. The device as claimed in claim 1 wherein said body is composed of steel having a thickness in the range of 0.006 inch to 0.010 inch.

3. The device as claimed in claim 2 wherein said body is composed of high carbon steel having a thickness of 0.008 inch.

4. The device as claimed in claim 1 wherein the inside height of said flange is in the range of 1/32 of an inch to 3/32 of an inch.

5. The device as claimed in claim 4 wherein the inside height of said flange is 1/16 of an inch.

6. The device as claimed in claim 1 wherein said base is formed with a pair of through holes, said base affixed to said platform by an adhesive, said adhesive received within said holes.

7. The device as claimed in claim 1 wherein at least one end of said flange is tapered.

8. The device as claimed in claim 7 wherein said gripping means is a pair of pressure sensitive strips, each said strip having a removable release stratum superposed thereon.

9. The device as claimed in claim 1 wherein said gripping means is a gripping stratum.

10. The device as claimed in claim 9 wherein said gripping stratum is emery cloth.

* * * * *